US009567189B2

(12) United States Patent
Laughton

(10) Patent No.: US 9,567,189 B2
(45) Date of Patent: Feb. 14, 2017

(54) ELEVATOR ROLLER GUIDE

(71) Applicant: ELEVATOR SAFETY COMPANY, Owings Mills, MD (US)

(72) Inventor: Andrew James Laughton, Ellicott City, MD (US)

(73) Assignee: ELEVATOR SAFETY COMPANY, Owings Mills, MD (US)

( * ) Notice: Subject to any disclaimer, the term of this patent is extended or adjusted under 35 U.S.C. 154(b) by 383 days.

(21) Appl. No.: 14/274,617

(22) Filed: May 9, 2014

(65) Prior Publication Data

US 2015/0321885 A1 Nov. 12, 2015

(51) Int. Cl.
*B66B 7/04* (2006.01)

(52) U.S. Cl.
CPC ..... *B66B 7/046* (2013.01); *B66B 7/04* (2013.01); *B66B 7/048* (2013.01)

(58) Field of Classification Search
CPC ..... B66B 7/046; B66B 7/048
See application file for complete search history.

(56) References Cited

U.S. PATENT DOCUMENTS 2,100,169 A * 11/1937 Norton ..... B66B 7/046 187/406
2,253,820 A * 8/1941 Spiro ..... B66B 7/046 187/410
3,087,583 A * 4/1963 Bruns ..... B66B 7/046 187/406
3,329,240 A * 7/1967 Harwood ..... B66B 7/046 187/410
3,783,978 A * 1/1974 Hamilton ..... B66B 5/022 187/278
5,984,053 A * 11/1999 Lee ..... B66B 7/046 182/141
6,050,370 A * 4/2000 Jung ..... B66B 7/048 187/409
6,062,347 A * 5/2000 Traktovenko ..... B66B 7/048 187/409
7,562,749 B2 * 7/2009 Race, Sr. ..... B66B 7/046 187/409

FOREIGN PATENT DOCUMENTS

DE 1215321 B * 4/1966 ..... B66B 7/046

OTHER PUBLICATIONS

EPO, Machine Translaton, DE 1215321 B, pp. 1-6.*

* cited by examiner

*Primary Examiner* — William A Rivera
*Assistant Examiner* — Stefan Kruer
(74) *Attorney, Agent, or Firm* — Merek, Blackmon & Voorhees, LLC

(57) ABSTRACT

An elevator roller guide configured to ride along a rail having a base member and a rail member. The rail member has a front face, a first side and a second side. The rail member further extends substantially perpendicular to the base member. The elevator roller guide preferably includes a car movement compensation member configured to maintain the face roller in contact with the front face of the rail member when the elevator car moves a first distance in a direction transverse to the rail member wherein the first distance is a distance that would cause the face roller to slide off or lose meaningful and/or substantial contact with the front face of the rail member without the car movement compensation member.

18 Claims, 8 Drawing Sheets

ELEVATOR ROLLER GUIDE

FIELD OF THE INVENTION

The present invention is directed to elevator roller guides used for guiding the movement of an elevator car along guide rails installed in a shaft or hoistway of a building structure.

BACKGROUND OF THE INVENTION

Typically, an elevator car travels along a pair of opposing guide rails located in a shaft or hoistway of a building structure. It is customary to employ four roller guides per elevator car to guide the elevator car along the guide rails as the car is moved in a shaft or hoist way. Two of the rollers guides are secured to the upper portion of the elevator car in such a manner as to engage the corresponding guide rails. The remaining two roller guides are secured to the lower portion of the elevator car in a similar manner to engage the corresponding guide rails. Typically, roller guides have a plurality of rollers that engage and travel along the corresponding guide rail. Typically, each roller guide includes three or six rollers. The present invention is not limited to elevator roller guides having a particular number of rollers. Rather, the present invention can be used in elevator roller guides having differing numbers of rollers.

A significant problem may arise with conventional elevator roller guides when an elevator car moves transverse or across the guide rails as conventional elevator roller guides cannot readily compensate for this crosswise movement of the elevator car. This is particularly problematic as elevator guide rails are becoming narrower than ever. In conventional roller guides, the transverse movement of the elevator car causes the face roller of the elevator to move across the front face of the rail member of the guide rail. The transverse movement across the front face of the rail member can be so significant that the face roller of an elevator roller guide slides off of the front face of the rail member of the guide rail and/or the face roller loses meaningful and/or substantial contact with the front face of the rail member of the guide rail. Obviously, this will have an extremely adverse effect on the elevator car and its ability to smoothly ascend and descend in a building structure.

OBJECTS AND SUMMARY OF THE INVENTION

An object of the present invention is to provide a novel and unobvious elevator roller guide.

Another object of a preferred embodiment of the present invention is to provide an elevator roller guide that can readily compensate for transverse movement of an elevator car.

A further object of a preferred embodiment of the present invention is to provide an elevator roller guide than can be used in building structures employing narrow elevator guide rails.

Yet another object of a preferred embodiment of the present invention is to provide an elevator roller guide which allows the face roller to pivot to ensure that the face roller does not lose substantial and/or meaningful contact with the rail member of an elevator guide rail when an elevator car moves in a direction transverse to the elevator guide rail.

Still another object of a preferred embodiment of the present invention is to provide an elevator roller guide with a car movement compensation member configured to maintain the face roller in contact with the front face of the rail member when the elevator car moves a first distance in a direction transverse to the rail member wherein the first distance is a distance that would cause the face roller to slide off of the front face of the rail member without the car movement compensation member.

Yet still another object of a preferred embodiment of the present invention is to provide a roller guide with a support arm moveably supported on a base where the support arm supports at least a face roller and a side roller such that the face roller and side roller move together.

Another object of a preferred embodiment of the present invention is to provide a roller guide with a support arm rotatably supported on a base where the support arm supports at least a face roller and a side roller such that the face roller and side roller rotate together relative to the base.

A further object of a preferred embodiment of the present invention is to provide an elevator roller guide having a support arm supporting a face roller and a side roller where the support arm is moveably supported on a base and a control member controlling the relative motion between the support arm and the base.

A still further object of a preferred embodiment of the present invention is to provide a roller guide having a support arm supporting a face roller and a side roller where the support arm is moveably supported on a base and an adjustable stop limiting the extent of relative motion between the support arm and the base.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to an elevator roller guide configured to ride along a rail having a base member and a rail member. The rail member has a front face, a first side and a second side. The rail member further extends substantially perpendicular to the base member. The elevator roller guide includes a base, a face roller and at least one side roller. The face roller extends substantially perpendicular to the at least one side roller. The base supports the face roller and the at least one side roller such that when the elevator roller guide is installed on an elevator car in an operating position the face roller engages the front face of the rail member and the at least one side roller engages one of the first side and the second side of the rail member. The elevator roller guide further includes a car movement compensation member configured to maintain the face roller in contact with the front face of the rail member when the elevator car moves a first distance in a direction transverse to the rail member wherein the first distance is a distance that would cause the face roller to slide off of the front face of the rail member without the car movement compensation member.

Another preferred embodiment of the present invention is directed to an elevator roller guide configured to ride along a rail having a base member and a rail member. The rail member has a front face, a first side and a second side. The rail member further extends substantially perpendicular to the base member. The elevator roller guide includes a base, a face roller and at least one side roller. The face roller extends substantially perpendicular to the at least one side roller. The base supports the face roller and the at least one side roller such that when the elevator roller guide is installed on an elevator car in an operating position the face roller engages the front face of the rail member and the at least one side roller engages one of the first side and the second side of the rail member. The elevator roller guide further includes a support member mounted to the base such that the support member is moveable relative to the base. The support member supports the face roller and the at least one side roller such that as the support member moves relative to the base the face roller and the at least one side roller move with the support arm and relative to the base.

A further preferred embodiment of the present invention is directed to an elevator roller guide configured to ride along a rail having a base member and a rail member. The rail member has a front face, a first side and a second side. The rail member further extends substantially perpendicular to the base member. The elevator roller guide includes a base, a face roller and at least one side roller. The face roller extends substantially perpendicular to the at least one side roller. The base supports the face roller and the at least one side roller such that when the elevator roller guide is installed on an elevator car in an operating position the face roller engages the front face of the rail member and the at least one side roller engages one of the first side and the second side of the rail member. The face roller is mounted on the base such that when the elevator car moves in a direction transverse to the rail member the face roller pivots about a first longitudinal axis so that a portion of the face roller maintains contact with the front face of the rail member. The first longitudinal axis extends substantially parallel to a longitudinal axis of the rail member.

DETAILED DESCRIPTION OF THE PREFERRED EMBODIMENTS OF THE INVENTION

The preferred forms of the invention will now be described with reference to FIGS. 1-10. The appended claims are not limited to the preferred forms and no term and/or phrase used herein is to be given a meaning other than its ordinary meaning unless it is expressly stated that the term and/or phrase shall have a special meaning.

FIGS. 1-9

Figure 7:
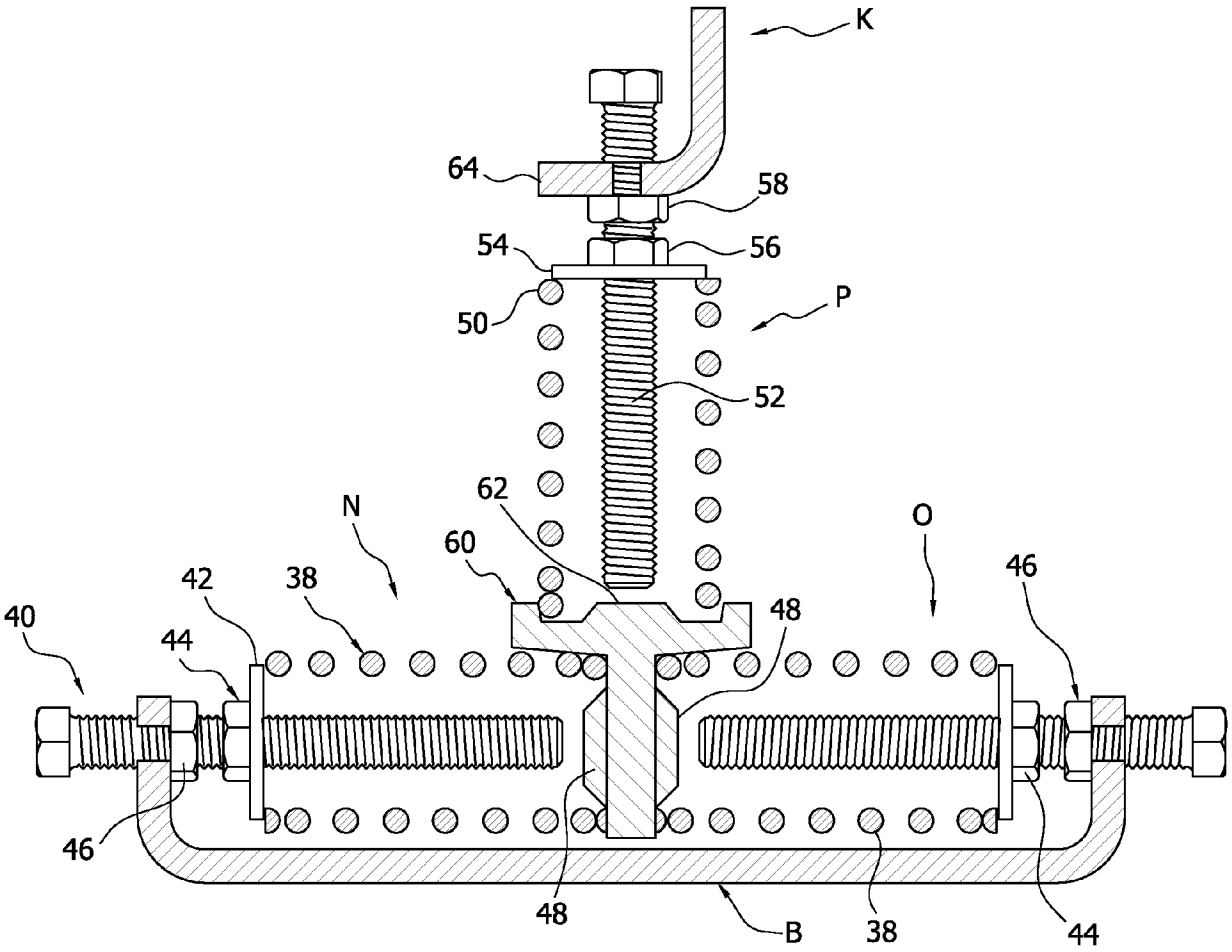
FIG. 7 is a fragmentary cross-sectional view of portions of the roller guide illustrated in FIG. 1.
Figure 8:
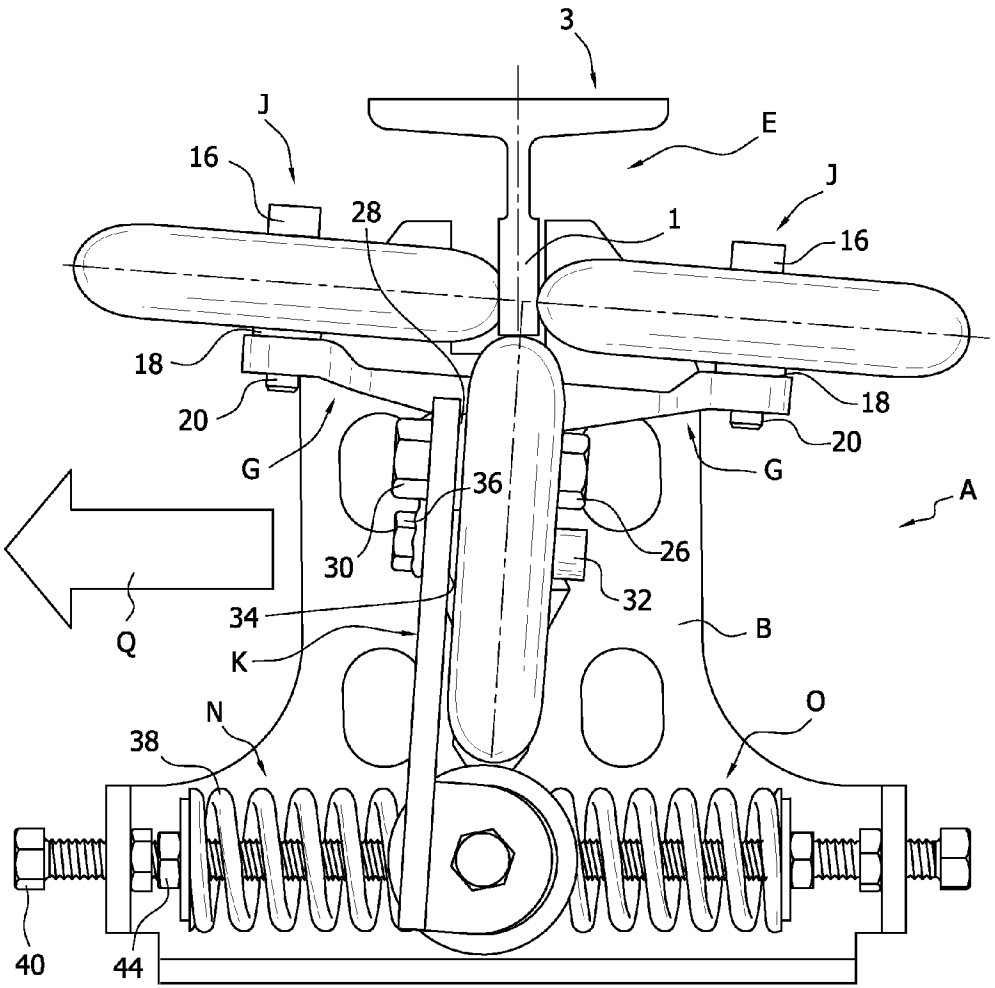
FIG. 8 is a plan view of the roller guide illustrated in FIG. 1 shown in engagement with a guide rail.

Referring to FIGS. 1 to 9, an elevator roller guide A is illustrated in one of many possible configurations. Elevator roller guide A includes a base B, a face roller or wheel C and pair of side rollers or wheels D. Referring to FIG. 8, when elevator roller guide A is installed in an operating position, face roller C engages a front face of rail member 1 of elevator guide rail E and side rollers D engage a corresponding side of rail member 1 of elevator guide rail E. Elevator guide rail E further includes a base member 3 that extends perpendicular to rail member 1. While this preferred embodiment utilizes three rollers, the present invention is not limited to elevator roller guides having three rollers. Rather, the number of rollers can be varied as desired.

Elevator roller guide A further includes support member F mounted on base B. Support member F includes a forward arm G and a rear arm H. Preferably, support member F is rotatably mounted on base B by fastener assembly I. Referring to FIGS. 1 to 3 and 9, fastener assembly I includes a bolt 2, a guide collar 4 and a nut 6. The nut 6 is fixed to base B. Guide collar 4 seats in bore 8 extending through rear arm H of support member F and receives bolt 2. End portion 10 of bolt 2 is threaded in the same manner as bolt 2 in the alternative embodiment depicted in FIG. 10 and mates with nut 6 having complementary threads.

Figure 1:
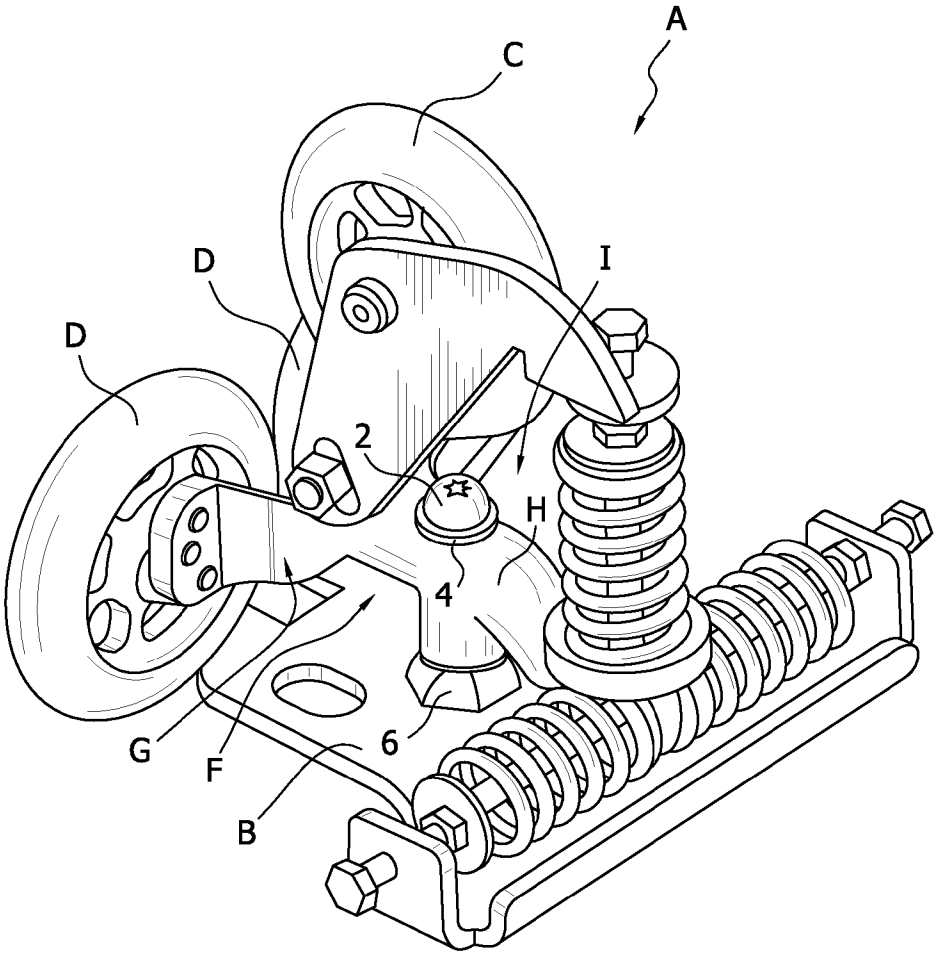
FIG. 1 is a perspective view of an elevator roller guide formed in accordance with a preferred embodiment of the present invention.
Figure 2:
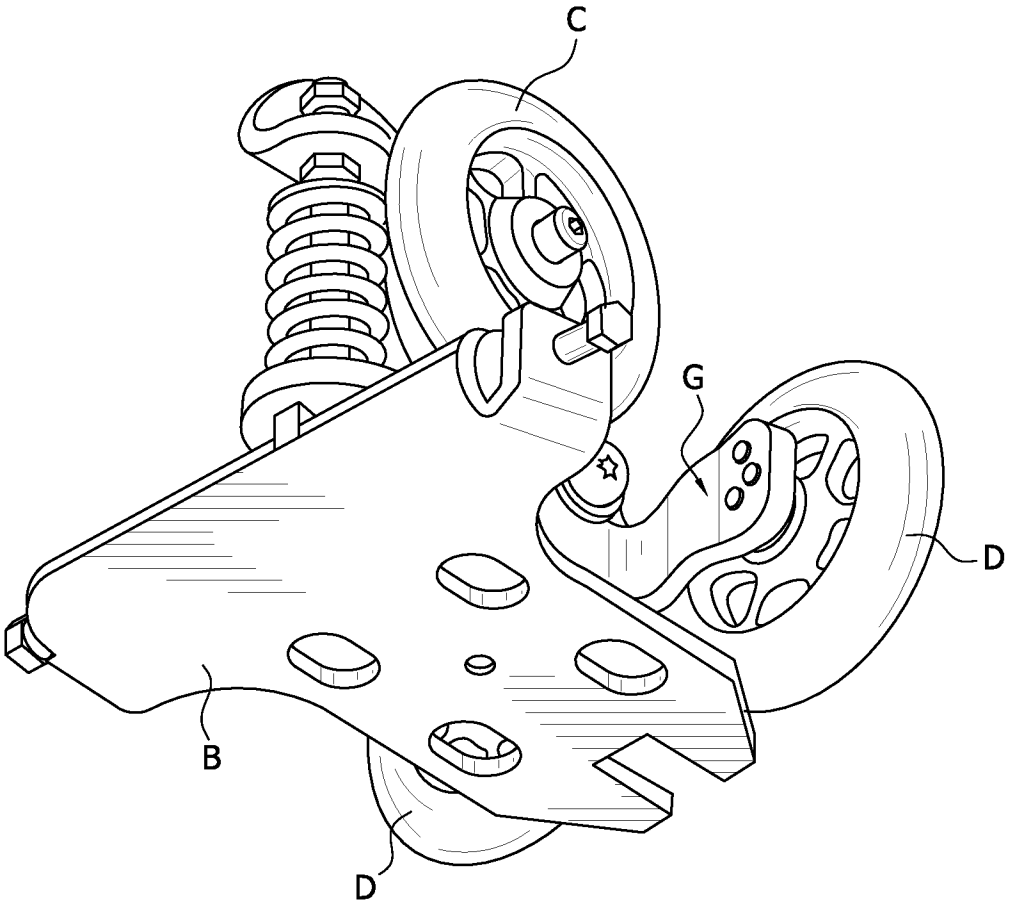
FIG. 2 is another perspective view of the elevator roller guide illustrated in FIG. 1 taken from a different vantage point than FIG. 1.
Figure 3:
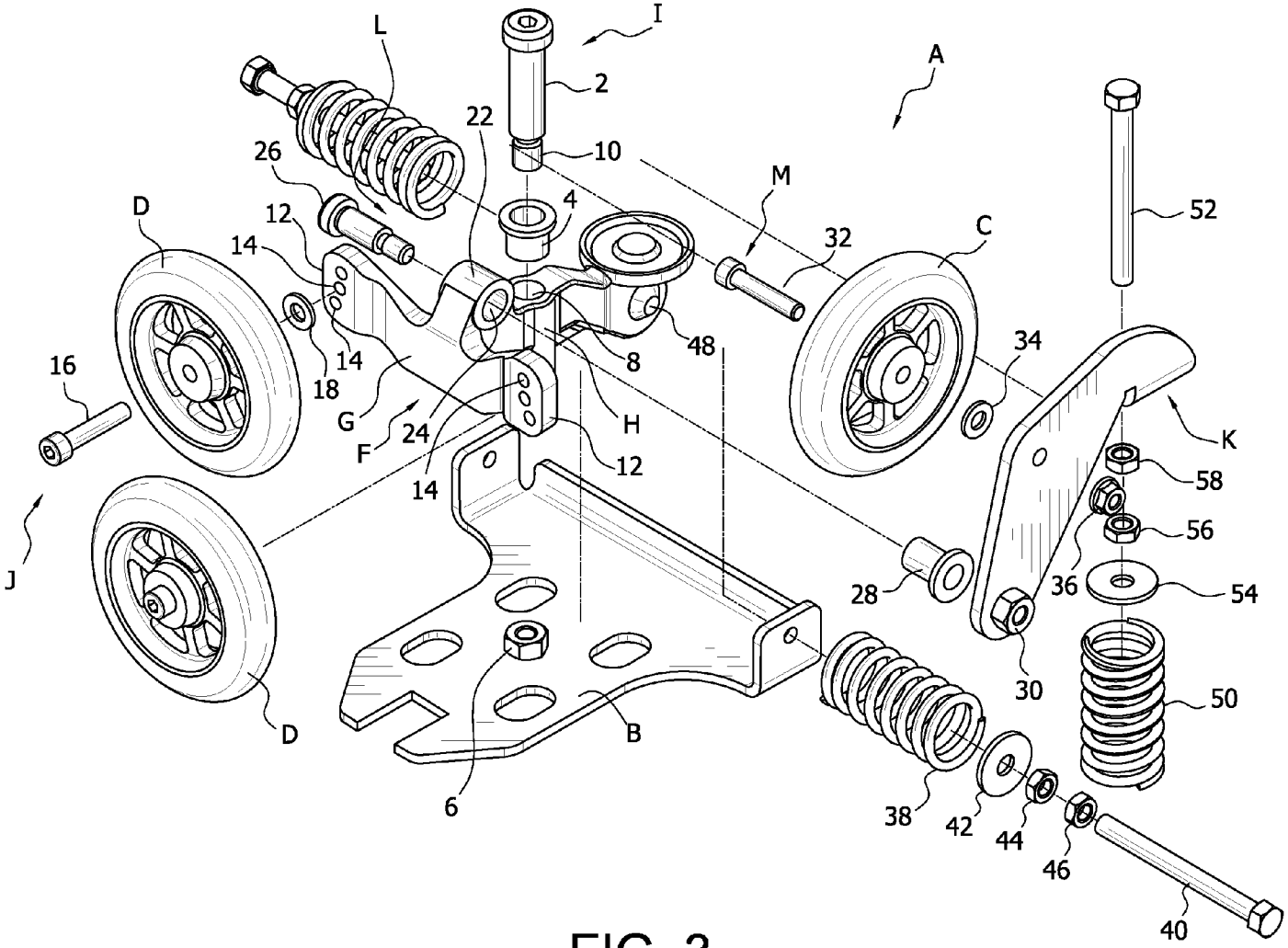
FIG. 3 is an exploded view of the roller guide illustrated in FIG. 1.
Figure 6:
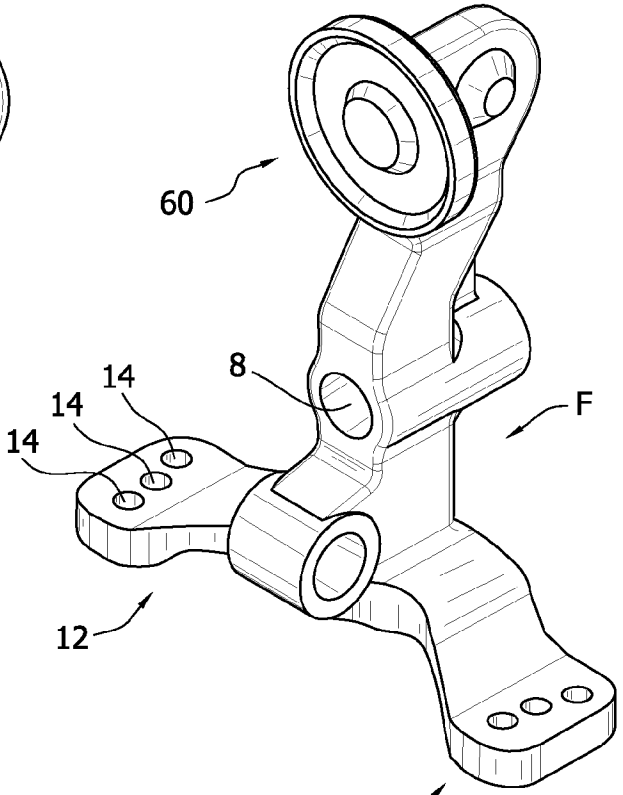
FIG. 6 is a perspective view of the support member of the roller guide illustrated in FIG. 4.
Figure 5:
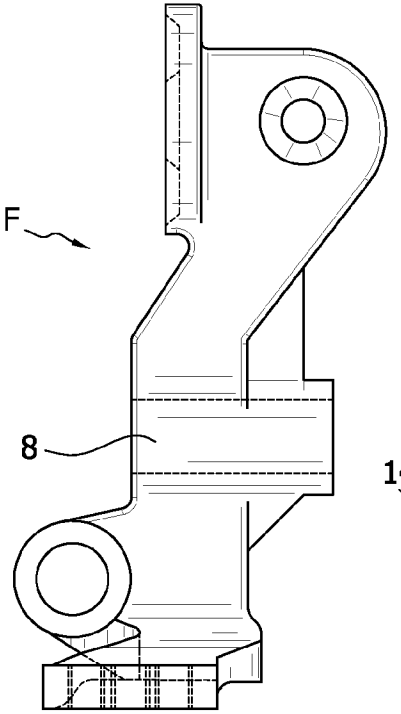
FIG. 5 is an elevation view of the support member of the roller guide illustrated in FIG. 4.
Figure 4:
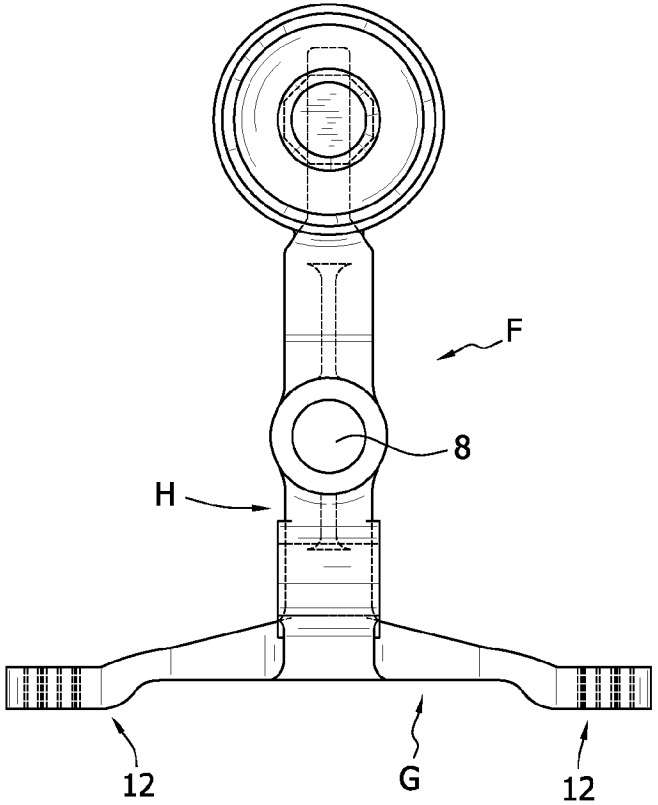
FIG. 4 is a plan view of the support member of the roller guide illustrated in FIG. 1.
Figure 9:
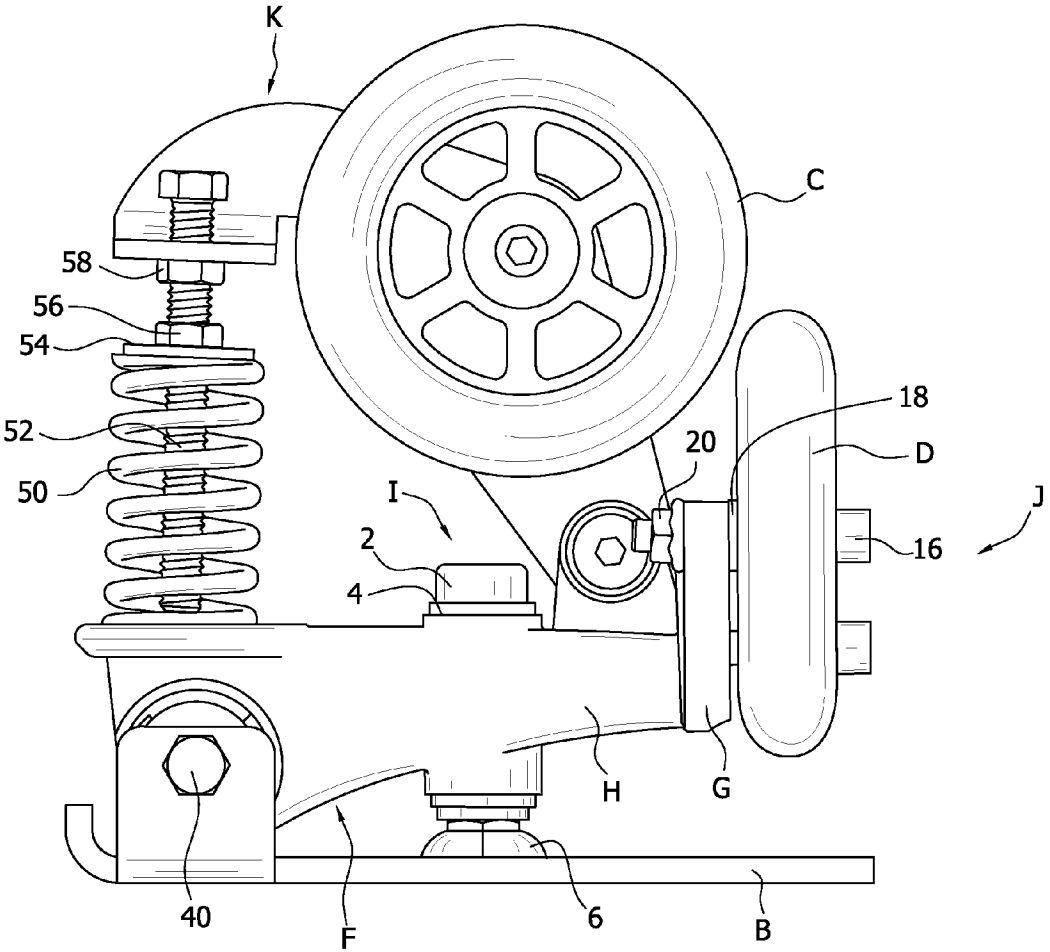
FIG. 9 is an elevation view of the roller guide illustrated in FIG. 1.

One side roller D is rotatably mounted on each end 12 of forward arm G of support member F by fastener assembly J. Each end 12 of support member F preferably includes three openings 14 that allow for alternate positioning of the corresponding side roller on forward arm G. It will be readily appreciated that the number and position of openings 14 may be varied as desired. Fastener assembly J includes a bolt 16, a washer 18 and a nut 20 as seen in FIGS. 3, 8 and 9. Bolt 16 is threaded in the same manner as bolt 16 in the alternative embodiment depicted in FIG. 10 and mates with nut 20 having complementary threads. Fastener assembly J is configured such that side rollers D are free to rotate about the corresponding bolt 16.

Face roller support arm K is rotatbly mounted on rear arm H of support member F by fastener assembly L. Specifically, rear arm H includes a collar 22 having a bore 24 extending through collar 22. Fastener assembly L includes a bolt 26, a guide collar 28 and nut 30. Referring to FIG. 3, guide collar 28 seats in bore 24 and receives bolt 26. Bolt 26 is threaded in a similar manner to bolt 26 of the alternative embodiment depicted in FIG. 10 and mates with nut 30 having complementary threads. Fastener assembly L is configured such that face roller support arm K is free to rotate about the corresponding bolt 26.

Face roller C is rotatably mounted on face roller support arm K by fastener assembly M. Fastener assembly M includes bolt 32, washer 34 and nut 36. Bolt 32 is threaded in the same manner as bolt 32 in the alternative embodiment depicted in FIG. 10 and mates with nut 36 having complementary threads. Fastener assembly M is configured such that face roller C is free to rotate about bolt 32.

Referring to FIGS. 3, 7 and 8, control spring assemblies N and O are disposed on opposite sides of the rear portion of rear arm H of support member F. Control spring assemblies N and O are identical and, therefore, only control spring assembly N will be discussed in detail. Control spring assembly N includes spring 38, bolt 40, washer 42, spring tension adjustment nut 44 and arm travel setting nut 46. Raised portions 48 are formed on opposite sides of rear arm H to provide a contact surface for the adjacent end of bolt 38 to limit movement of support member F. By adjusting the position of spring tension adjustment nut 44, the spring force of spring 38 can be readily varied. Also, by adjusting the position of arm travel setting nut 46 from the head of bolt 38, the distance support member F can travel before bolt 38 engages raised portion 48 can be readily varied.

Referring to FIGS. 3, 7 and 9, control spring assembly P is operably connected at the lower end to rear arm H and at the upper end to face roller support arm K. Control spring assembly P includes spring 50, bolt 52, washer 54, spring tension adjustment nut 56 and arm travel setting nut 58. The lower end of spring 50 seats in spring seat 60 formed in rear arm H. Spring seat 60 acts to maintain spring 50 in the proper position when elevator roller guide A is in use. Raised portion 62 is formed in the center of spring seat 60 to provide a contact surface for the adjacent end of bolt 52 to limit movement of face roller support arm K. Lip 64 of face roller support arm K has threads complementary to the threads of bolt 52. Arm travel setting nut 58 fixes lip 64 to bolt 52 so that face roller support arm K cannot move relative to bolt 52. By adjusting the position of spring tension adjustment nut 56, the spring force of spring 38 can be readily varied. Also, by adjusting the position of arm travel setting nut 58 from the head of bolt 52, the distance face roller support arm K can travel before bolt 52 engages raised portion 62 can be readily varied.

Referring to FIGS. 7 and 8, the operation of elevator roller guide A will now be discussed. Side rollers D engage and run along opposing sides of the rail member 1. The three openings 14 allow for alternate positioning of side rollers D on forward arm G of support member F to readily accommodate for varying installation site conditions, e.g., varying rail member thickness.

Face roller C engages and runs along the front face of rail member 1. Spring 50 urges face roller C in contact with the front face of rail member 1. During operation of elevator roller guide A, it may be necessary for face roller C to move in a direction away from rail member 1. For example, if face roller C encounters a protruding surface irregularity on the front face of rail member 1, face roller support arm K will pivot about bolt 26 such that face roller C moves in a direction away from rail member 1 against the force of spring 50. However, the extent of this movement is limited to the preset distance between raised portion 62 and bolt 52. As previously explained, this preset distance can be readily varied by varying the position of arm travel setting nut 58 from the head of bolt 52. Once face roller C moves past the surface irregularity, spring 50 urges face roller support arm K forward.

When the elevator car experiences transverse movement represented by arrow Q in FIG. 8, elevator guide A can readily accommodate this movement while ensuring that face roller C and side rollers D maintain meaningful and substantial contact with rail member 1. Specifically, transverse movement of the elevator car in the direction of arrow Q will cause support member F to pivot or rotate clockwise about bolt 2 which in turn compresses spring 38 of control spring assembly N. Face roller C and side rollers D pivot/rotate together with support member F. Specifically, as seen in FIG. 8, face roller C pivots such that the rearward portion of face roller C moves in the direction of arrow Q while the forward portion of face roller C remains in meaningful and substantial contact with the front face of rail member 1. The same is true of side rollers D which pivot but remain in substantial contact with the corresponding side of rail member 1. As will be readily appreciated, if the elevator car movement is in a direction opposite to arrow Q, then support member F will pivot/rotate counterclockwise against the force of spring 38 of spring control assembly O.

FIG. 10

Figure 10:
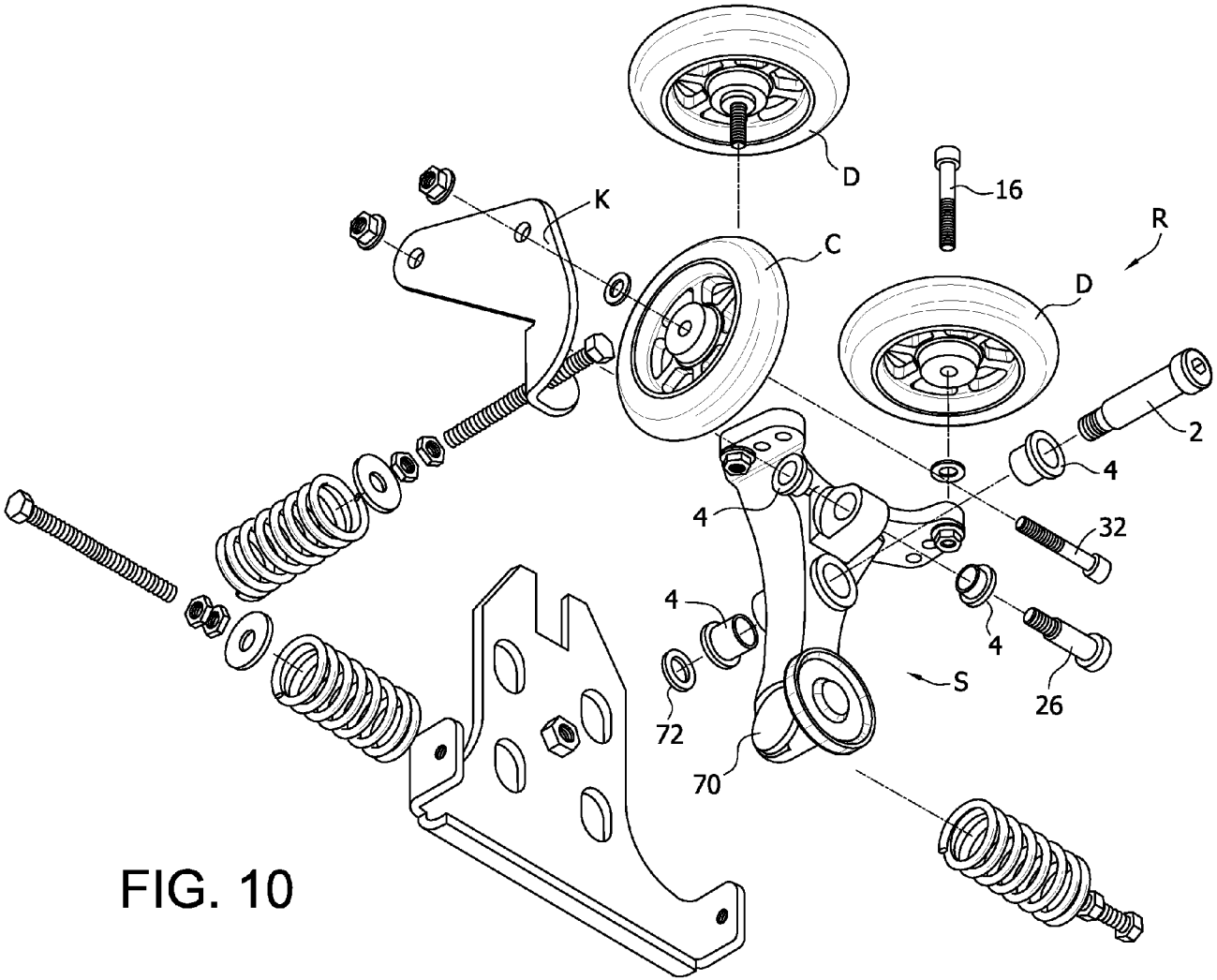
FIG. 10 is an exploded view of the roller guide formed in accordance with an alternative embodiment.

Referring to FIG. 10, an elevator roller guide R formed in accordance with an alternative embodiment is illustrated in one of many possible configurations. Elevator roller guide R has a number of identical and/or substantially identical components to elevator roller guide A and such components have been given the same reference numerals. Due to the similarity between elevator roller guides R and A, only the differences will be described.

Roller guide R includes support member S which is similar but differs from support member F of elevator roller guide A. Specifically, opposing raised portions 70 (only one of which is shown in FIG. 10) have a different configuration than opposing raised portions 48 of elevator roller guide A. This embodiment further uses two guide collars 4 (upper and lower) to mount support member S to base B and to mount face roller support arm K on support member S. In addition, a washer 72 is employed between base nut 6 and the adjacent guide collar 4.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. An elevator roller guide configured to ride along a rail having a base member and a rail member, the rail member having a front face, a first side and a second side, the rail member further extending substantially perpendicular to the base member, the elevator roller guide comprising:

(a) a base, a vertically extending member having a vertical axis and a roller support rotatably supported by said vertically extending member;

(b) a face roller and at least one side roller each being rotatably supported by said roller support, said face roller extending substantially perpendicular to said at least one side roller, said roller support supporting said face roller and said at least one side roller such that when the elevator roller guide is installed on an elevator car in an operating position said face roller engages the front face of the rail member and said at least one side roller engages one of said first side and said second side of said rail member; and, (c) said roller support being configured to maintain said face roller in contact with said front face of said rail member when the elevator car moves a first distance in a direction transverse to said rail member by rotating about said vertical axis of said vertically extending member when the elevator car moves in the first direction.

2. The elevator roller guide as set forth in claim 1, wherein:

(a) said vertically extending member includes a shaft and said shaft extends through said roller support.

3. The elevator roller guide as set forth in claim 2, wherein:

(a) said shaft includes a first end connected to said base and a second end extending above at least a portion of said at least one side roller.

4. The elevator roller guide as set forth in claim 1, wherein:

(a) said roller support includes a forward arm and a rear arm, said rear arm is connected to a center section of said forward arm; and, (b) said at least one side roller includes a first side roller and a second side roller, said first side roller is rotatably mounted on a first end of said forward arm and said second side roller is rotatably mounted on a second end of said forward arm.

5. The elevator roller guide as set forth in claim 4, further including:

(a) a first spring and a second spring, said first spring engages a first portion of said rear arm and said second spring engages a second portion of said rear arm, said second portion is disposed opposite said first portion and said first spring is aligned with said second spring;

(b) a face roller arm mounted on said roller support, said face roller being rotatably mounted on said face roller arm; and, (c) a third spring engaging at least a portion of said face roller arm and at least a portion of said rear arm of said roller support.

6. The elevator roller guide as set forth in claim 5, wherein:

(a) a center axis of said face roller is disposed above a center axis of said first side roller and a center axis of said second side roller.

7. The elevator roller guide as set forth in claim 1, further including:

(a) a roller support arm rotatably connected to said roller support, said roller support arm being configured to rotate with said roller support and rotate toward and away from said rail member.

8. An elevator roller guide configured to ride along a rail having a base member and a rail member, the rail member having a front face, a first side and a second side, the rail member further extending substantially perpendicular to the base member, the elevator roller guide comprising:

(a) a base, a support member, a substantially vertically extending shaft, a face roller and at least one side roller, said face roller extending substantially perpendicular to said at least one side roller, said support member supporting said face roller and said at least one side roller such that when the elevator roller guide is installed on an elevator car in an operating position said face roller engages said front face of said rail member and said at least one side roller engages one of said first side and said second side of said rail member; and, (b) said support member being rotatably mounted on said substantially vertically extending shaft such that said support member rotates about said substantially vertically extending shaft relative to said base, said support member supporting said face roller and said at least one side roller such that said face roller and said at least one side roller move with said support member and relative to said base.

9. The elevator roller guide as set forth in claim 8, wherein:

(a) said at least one side roller includes a first side roller and a second side roller and said support member supports said face roller, said first side roller and said second side roller.

10. The elevator roller guide as set forth in claim 9, wherein:

(a) a center axis of said face roller is disposed above a center axis of said first side roller and a center axis of said second side roller.

11. The elevator roller guide as set forth in claim 10, further including:

(a) a first spring, a second spring and a third spring;

(b) a face roller arm mounted on said support member, said face roller being rotatably mounted on said face roller arm; and, (c) said support member having a rear arm, said first spring and said second spring engaging opposite sides of said rear arm, said third spring engaging at least a portion of said face roller arm and at least a portion of said rear arm of said support member.

12. The elevator roller guide as set forth in claim 11, wherein:

(a) said third spring is disposed above said first spring and said second spring, said third spring extends substantially perpendicular to said first spring and said second spring.

13. The elevator roller guide as set forth in claim 11, wherein:

(a) said first spring, said second spring and said third spring are disposed adjacent a rear edge of said base; and, (b) said first side roller and said second side roller are disposed adjacent a front edge of said base.

14. The elevator roller guide as set forth in claim 10, further including:

(a) at least one spring for controlling movement of said support member relative to said base.

15. An elevator roller guide configured to ride along a rail having a base member and a rail member, the rail member having a front face, a first side and a second side, the rail member further extending substantially perpendicular to the base member, the elevator roller guide comprising:

(a) a base, a support member, a face roller and at least one side roller, said face roller extending substantially perpendicular to said at least one side roller, said support member supporting said face roller and said at least one side roller such that when the elevator roller guide is installed on an elevator car in an operating position said face roller engages said front face of said rail member and said at least one side roller engages one of said first side and said second side of said rail member; and, (b) said face roller being mounted on said support member, and said support member being mounted on said base such that when the elevator car moves in a direction transverse to said rail member said support member pivots about a first longitudinal axis so that a portion of the face roller maintains contact with said front face of said rail member, the first longitudinal axis extending substantially parallel to a longitudinal axis of said rail member.

16. The elevator roller guide as set forth in claim 15, further including:

(a) a vertical shaft having the first longitudinal axis and extending upwardly from said base and said support member being rotatably mounted on said vertical shaft.

17. The elevator roller guide as set forth in claim 16, wherein:

(a) said vertical shaft extends through said support member.

18. The elevator roller guide as set forth in claim 17, further including:

(a) at least one spring for controlling rotation of said support member relative to said base; and, (b) at least one adjustable stop member for limiting rotation of said support member relative to said base.

* * * * *